US005561948A

United States Patent [19]

Wu

[11] Patent Number: 5,561,948

[45] Date of Patent: Oct. 8, 1996

[54] DEVICE FOR MANUALLY CONTROLLING A POWER WINDOW OF AN AUTOMOBILE

[76] Inventor: Ming-Kuei Wu, P.O. Box 82-144, Taipei, Taiwan

[21] Appl. No.: 450,910

[22] Filed: May 26, 1995

[51] Int. Cl.[6] ..... E05F 15/00

[52] U.S. Cl. ..... 49/139; 49/349

[58] Field of Search ..... 49/139, 140, 354, 49/353, 349

[56] References Cited

U.S. PATENT DOCUMENTS

| | | | |
|---|---|---|---|
| 2,621,544 | 12/1952 | Rossmann | 49/140 X |
| 2,900,183 | 8/1959 | Leslie et al. | 49/139 X |
| 3,791,071 | 2/1974 | Niklaus | 49/140 |
| 4,257,192 | 3/1981 | Bartholomew | 49/140 |
| 4,267,668 | 5/1981 | Natinsky | 49/139 X |
| 4,314,692 | 2/1982 | Brauer et al. | 49/139 X |
| 5,024,022 | 6/1991 | Ito | 49/139 |

*Primary Examiner*—Philip C. Kannan
*Attorney, Agent, or Firm*—Alfred Lei

[57] ABSTRACT

A device for manually controlling a power window of an automobile including a connector formed with a cavity at a lower end and a rectangular recess at an upper end, a sleeve fixedly fitted on a bearing mounted on an upper end of an electric motor, a flexible tube having a lower end fixedly engaged with the sleeve, a ferrule inserted through a covering panel mounted at an inner side of an automobile door so as to engage with the other end of the flexible tube, and a turning mechanism including a handwheel, a tubular member disposed at one side of said handwheel, and a cable extending through the tubular member to engage with a central portion of the handwheel and having a rectangular lower end adapted to engage with the rectangular recess of the connector.

2 Claims, 3 Drawing Sheets

DEVICE FOR MANUALLY CONTROLLING A POWER WINDOW OF AN AUTOMOBILE

BACKGROUND OF THE INVENTION

1. Field of the Invention

This invention relates to a manual control device and in particular to one which is designed for opening or closing a power window in the event that the power window does not work properly.

2. Description of the Prior Art

It has been found that the conventional power window of an automobile is operated by an electric motor. However, in case of power failure, it will be impossible to operate the power window thereby causing much inconvenience in use.

Therefore, it is an object of the present invention to provide a device which can be used to operate the power window when it does not work properly.

SUMMARY OF THE INVENTION

This invention is directed to a device for manually controlling a power window of an automobile.

It is the primary object of the present invention to provide a device which can be used to open or close a power window of an automobile when it does not work properly.

It is another object of the present invention to provide a device for manually controlling a power window of an automobile which will not damage the covering panel mounted on the inner side of the automobile door.

It is still another object of the present invention to provide a manual control device which can be adapted for use with any automobile.

It is still another object of the present invention to provide a device for manually controlling a power window of an automobile which is easily installed.

It is a further object of the present invention to provide a device for manually controlling a power window of an automobile which is simple in construction.

DETAILED DESCRIPTION OF THE PREFERRED EMBODIMENT

Before explaining the present invention in detail, it is to be understood that the invention is not limited in its application to the details of construction and arrangement of parts illustrated in the accompanying drawings, since the invention is capable of other embodiments and of being practiced or carried out in various ways. Also it is to be understood that the phraseology or terminology employed herein is for the purpose of description and not of limitation.

Figure 1:
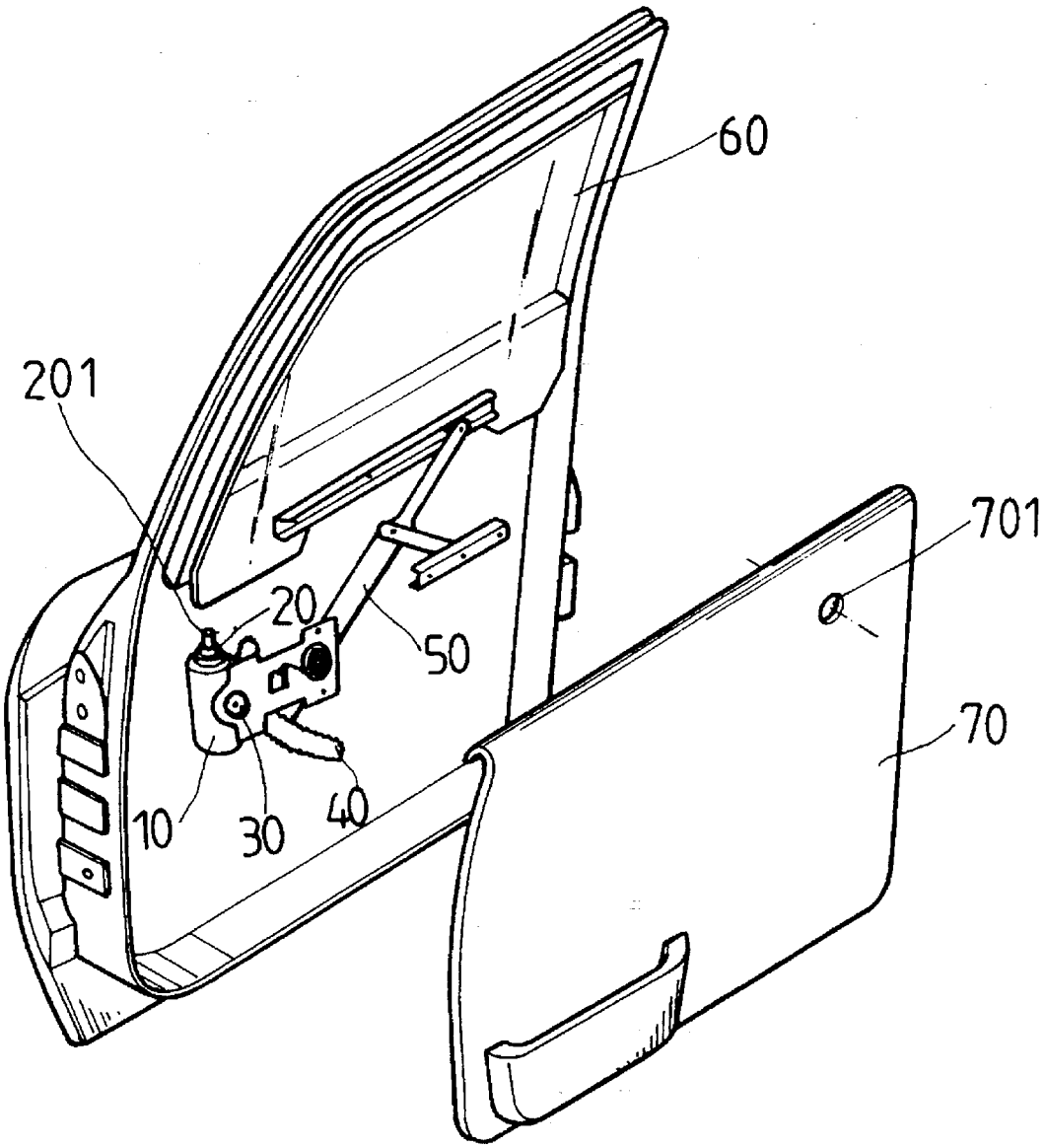
FIG. 1 shows the structure of a power window.
Figure 2:
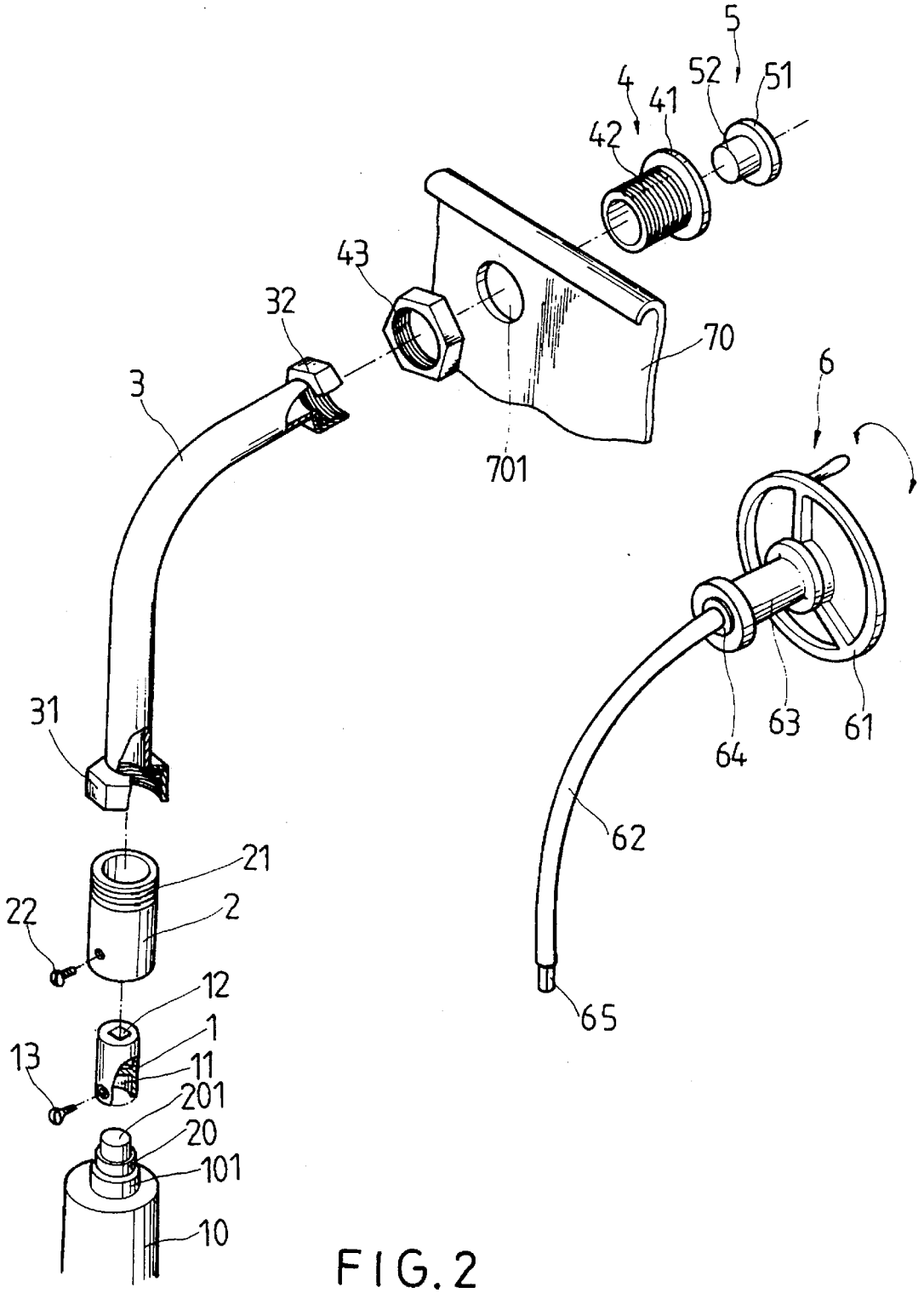
FIG. 2 is an exploded view of the device for manually controlling the power window of an automobile according to the present invention.
Figure 3:
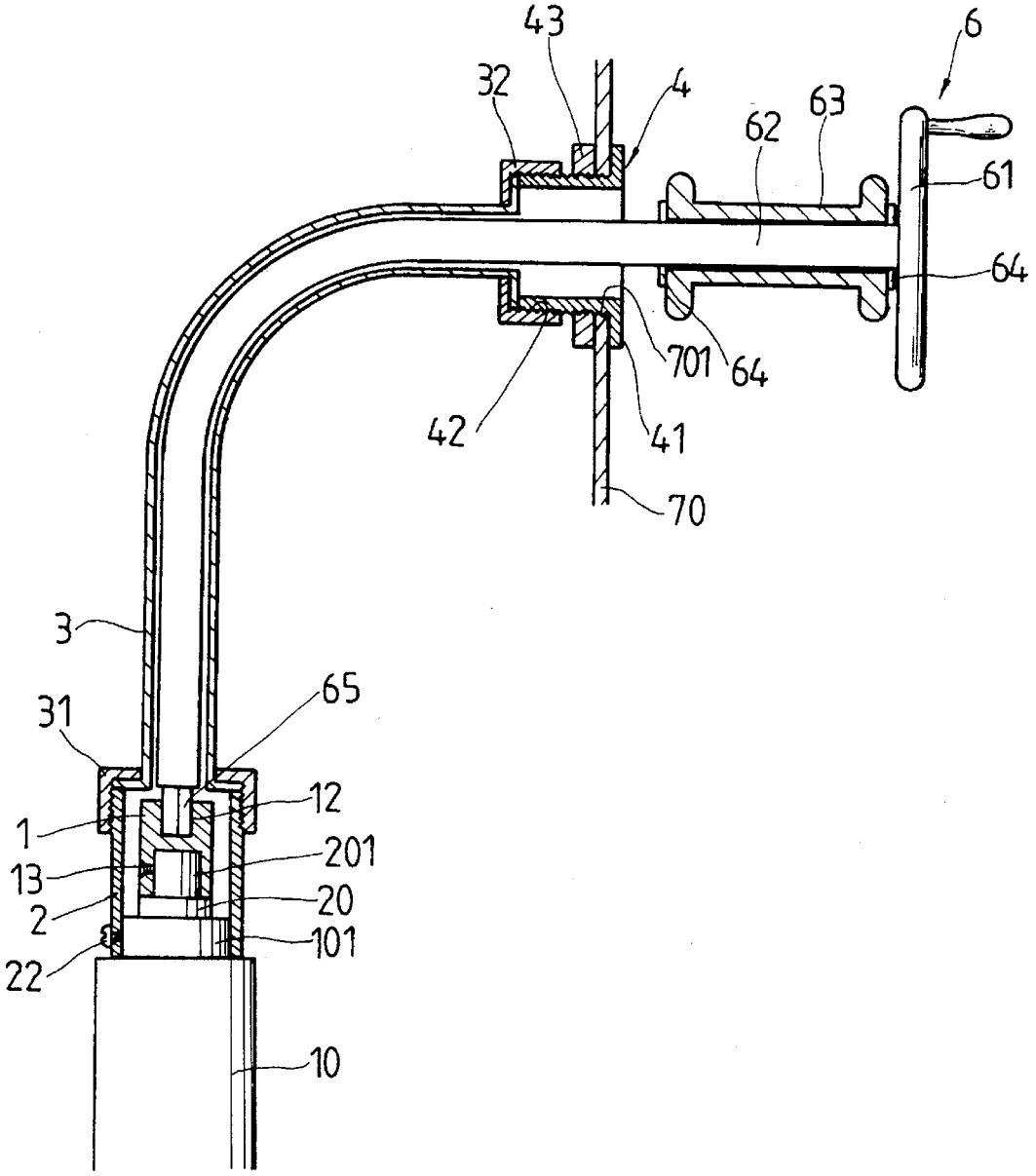
FIG. 3 is a sectional view of the present invention

With reference to the drawings and in particular to FIGS. 1 and 2 thereof, the device for manually controlling a power window of an automobile mainly comprises a connector 1, a sleeve 2, a flexible tube 3, a ferrule 4, a plug 5, and a turning mechanism 6.

Referring to FIG. 1, the power window includes an electric motor 10 having an axle 20, a gear 30 engaged with the axle 20, a toothed rack 40 meshed with the gear 30, an arm 50 driving connected with the toothed rack 40, and a window pane 60 mounted on the arm 50. The power window is well known in the art and not considered a part of the invention. The axle 20 extends upwardly out of the electric motor 10 and is supported by a bearing 101. Further, the axle 20 is formed with a smaller upper end 201.

The connector 1 is formed with a cavity 11 at the lower end and a rectangular recess 12 at the upper end. The upper end of the axle 20 is fitted within the cavity 11 of the connector 1 and secured thereto by a screw 13 so that the connector i will be rotated with the axle 20.

The sleeve 2 is fixedly fitted on the bearing 101 by a screw 22 or otherwise secured thereto, enclosing the connector 1 therein.

The flexible tube 3 is provided with a first nut 31 at the lower end and a second nut 32 at the upper end. The first nut 31 of the flexible tube 3 is threadedly engaged with the upper end 21 of the sleeve 2.

The ferrule 4 is a tubular member provided with external threads 42 thereon and a flange 41 at the outer end. The ferrule 4 is inserted through a hole 701 on the covering panel 70 mounted on the inner side of an automobile door to engage with a locking nut 43 thereby fastening the ferrule 4 in a fixed position. The second nut 32 of the flexible tube 3 is engaged with the threads 42 of the ferrule 4.

The plug 5 has a cylindrical portion adapted to fit into the ferrule 4 and a flattened head 51 for preventing the plug 5 to go into the ferrule 4 completely. In addition, the plug 5 is used to seal the ferrule 4 so as to keep the dust or the like from entering into the automobile door when the present invention is not in use.

The turning mechanism 6 includes a handwheel 61, a tubular member 63 disposed at one side of the handwheel 61, a cable 62 extending through the tubular member 63 to engage with the center of the handwheel 61 and having a rectangular lower end 65 adapted to engage with the rectangular recess 12 of the connector 1, and two packings 64 each fitted at an end of the tubular member 63.

In the event that the power supply is failed or the power window does not work properly, the plug 5 is first removed from the ferrule 4 and the cable 62 is inserted through the ferrule 4 to engage with the connector 12. Then, the handwheel 61 is turned to rotate the connector 12 which will in turn rotate the axle 20 of the electric motor 10. As the electric motor 10 is drivingly connected with the window pane 60, the window pane 60 will be controlled to go upward or downward by turning the handwheel 61.

The drawings and the foregoing descriptions are not intended to represent the only form of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

I claim:

1. In a power window for an automobile having an electric motor provided with an axle having an upper portion extending upwardly out of said electric motor and a bearing sleeved on the upper portion, and a manual control device drivingly connected with said electric motor, said manual control device comprising:

a connector formed with a cavity at a lower end and a rectangular recess at an upper end, said cavity being fixedly engaged with the upper portion of the axle of said electric motor;

a sleeve fixedly fitted on said bearing;

a flexible tube provided with a first nut at a lower end and a second nut at an upper end, said first nut being fixedly engaged with said sleeve;

a ferrule provided with external threads thereon and a flange at an outer end, said ferrule being inserted through a covering panel mounted at an inner side of a door of said automobile so as to engage with the second nut of said flexible tube; and a turning mechanism including a handwheel, a tubular member disposed at one side of said handwheel, and a cable extending through the tubular member to engage with a central portion of said handwheel and having a rectangular lower end adapted to engage with the rectangular recess of said connector.

2. The manual control device as claimed in Claim 1, further comprising a plug having a cylindrical portion adapted to fit into said ferrule and a flattened head for preventing said plug to go into said ferrule completely.

* * * * *